US005234161A

United States Patent [19]

Harrison, Jr. et al.

[11] Patent Number: 5,234,161

[45] Date of Patent: Aug. 10, 1993

[54] COUNTERFLOW SPRAY NOZZLE

[75] Inventors: Richard H. Harrison, Jr., Columbia; Bryan F. Garrish, Ellicott City, both of Md.

[73] Assignee: Baltimore Aircoil Company, Jessup, Md.

[21] Appl. No.: 879,983

[22] Filed: May 8, 1992

[51] Int. Cl.[5] ..... B05B 1/00; B05B 15/06

[52] U.S. Cl. ..... 239/1; 239/550; 239/590; 239/600

[58] Field of Search ..... 239/600, 568, 550, 552, 239/590, 590.3, 590.5, 524; 138/37

[56] References Cited

U.S. PATENT DOCUMENTS

| | | | |
|---|---|---|---|
| 2,605,140 | 7/1952 | Bartling | 239/550 X |
| 3,273,805 | 9/1966 | Hall | 239/600 X |
| 3,420,447 | 1/1969 | Howard | 239/550 |
| 4,058,261 | 11/1977 | Pollart | 239/550 X |
| 4,084,750 | 4/1978 | Fett | 239/600 |
| 4,390,478 | 6/1983 | Sheperd | 239/600 X |
| 4,498,626 | 2/1985 | Pitchford | 239/600 X |
| 4,819,878 | 4/1989 | Bailey et al. | 239/550 X |
| 4,848,672 | 7/1989 | Matsumoto et al. | 239/590.5 |

OTHER PUBLICATIONS

*Handbook of Hydraulic Resistence* by I. E. Idelchik (Hemisphere Publishing Company, second edition, 1986) p. 266.

*Primary Examiner*—Andres Kashnikow
*Assistant Examiner*—Kevin P. Weldon
*Attorney, Agent, or Firm*—Edward J. Brosius; F. S. Gregorczyk; Thomas J. Schab

[57] ABSTRACT

A large anti-vortexing nozzle is provided which may be used in a distribution system comprising multiple nozzles to uniformly distribute fluid to an underlying surface. The nozzle is non-clogging, operates at very low spray pressures, and evenly distributes fluid over a wide area due to its ability to eradicate vortex formations within the nozzle. The nozzle comprises a main body with integrally formed anti-vortexing ears extending upward from the top of the nozzle into the pipe and an underlying dual pyramid shaped deflecting apparatus. In operation, the nozzle produces consistent and continuous, multiple uniform flat planes of fluid because the nozzle now will not sputter, vibrate or induce air because ears on the nozzle eliminate vortex pair formations which are detrimental to nozzle performance.

13 Claims, 4 Drawing Sheets

COUNTERFLOW SPRAY NOZZLE

FIELD OF THE INVENTION

This invention relates generally to an improved spray nozzle which is used in fluid distribution systems. Specifically, this invention prevents the formation of vortex pairs within the nozzle and the associated pressure losses from those vortex pairs, thereby improving the nozzle performance characteristics.

BACKGROUND OF THE INVENTION

Evaporative cooling equipment such as cooling towers, evaporative condensers, and closed circuit fluid coolers are well known in the art. Such equipment has been used for many years to reject heat to the atmosphere. Cooling towers typically operate by distributing the water to be cooled over the top of a heat transfer surface and passing the water through the heat transfer surface while contacting the water with air. As a result of this contact, a portion of the water is evaporated into the air thereby cooling the remaining water.

In closed circuit fluid coolers and evaporative condensers, the fluid to be cooled, or the refrigerant to be condensed, is contained within a plurality of closed conduits. Cooling is accomplished by distributing cooling water over the outside of the conduits while at the same time contacting the cooling water with air.

In all applications of evaporative cooling equipment, proper water distribution within the equipment is critical to efficient performance of the equipment. Uneven distribution of water to the heat transfer surface will reduce the available air-to-water interfacial surface area which is necessary for heat transfer. Severe maldistribution of water may result in air flow being blocked through those areas of the heat transfer media which are flooded with water while at the same time causing air to bypass those areas of the media which are starved of water.

Generally, water distribution systems used in evaporative cooling equipment are either of the gravity feed type or the pressure spray distribution type. Gravity feed distribution system typically comprise a basin or pan which is positioned above the heat transfer media. In the bottom of the basin are positioned nozzles which operate to gravitationally pass water contained in the basin through the bottom of the basin while breaking up the water into smaller droplets and distributing the water droplets to the underlying heat transfer surface.

Pressure spray distribution systems, on the other hand, typically comprise multiple water distribution branches or headers, positioned above the heat transfer media with each branch containing a multitude of small spray nozzles. Generally, these nozzles are arranged closely in a uniform spacing in an attempt to achieve even water distribution across the typically rectangular top of the heat transfer surface.

Attempts have been made, especially in the utilization of pressure spray distribution systems, to develop nozzles which will allow for the reduction of the number of nozzles required in any given system while at the same time achieving uniform water distribution. However, in large towers nozzle clogging becomes a common problem due to the size of the tower components, allowing greater opportunity for foreign objects to find their way into the distribution system. To counteract this potential clogging problem, it is preferable on large towers to utilize nozzles with orifices as large as possible so that most debris can pass through the nozzle without becoming clogged. Unfortunately, as is known in the art, the larger the nozzle orifice, the more difficult it is to achieve uniform water distribution, so reducing the number of nozzles becomes an even greater challenge.

Another concern of cooling tower systems is the desire to keep the overall height of the evaporative cooling equipment to a minimum. This necessitates positioning the spray distribution system at a minimum distance above the top of the heat transfer surface. However, the closer the distribution system is to the top of the heat transfer surface, the less room there is for the water to be distributed evenly because of the smaller surface area the spray from each nozzle is generally able to cover.

Moreover, with any size of tower it is of critical importance to minimize the required spray water pumping pressure. Typically, pressure spray distribution systems have operated at spray pressures in the range of 3–8 psig (20.67–55.12 Pa). However, it is now desired to operate with spray pressures of no greater than 3 psig (20.67 Pa). This is especially true in very large towers since small increases in spray operating pressures can add hundreds of thousands of dollars to the operating cost of the unit over its lifetime. However, achieving uniform water distribution at low spray pressures is extremely difficult. This is due to the fact that at low spray pressures, there is very little energy available from the spray pressure to assist in spreading and distributing the water flow through the nozzles. It is also known in the art that the problems of low pressure distribution problems are further magnified by pressure losses occurring within the nozzle which are associated to the fluid frictionally scraping against the inside walls of the pipe. The magnitude of these frictional losses are influenced mainly by two factors which govern flow; flow turbulence and velocity profile shape. As explained in Chapter 6 of Handbook of Hydraulic Resistance, by I. E. Idelchik (Hemisphere Publishing Co., second edition, 1986), several other associated conditions or factors contribute to the magnitude of the turbulence and velocity profile factors, and they are: The Reynolds number; the relative roughness of the walls; the inlet conditions: relative length of straight starting section, the relative distance from the preceding shaped piece; and the geometric parameters of the pipe, like the angle of the bend, the relative radius of curvature, the aspect ratio, and the ratio of the inlet area to the exit area.

Each of these factors contribute to the magnitude of centrifugal forces which operate on the flow stream and hence, whether the presence of boundary layers along the walls of the pipe will appear within the velocity flow profile. As known, boundry conditions are adverse to uniform velocity flow profiles because they will cause a secondary flow within the pipe which is transverse to the actual fluid flow direction. This secondary flow is known in the art as the vortex pair, and the vortex formations impart enough centrifugal forces to the main flow stream to cause it to split into a dual pair spinning flow profiles that simultaneously travel down the pipe. The effect of of the dual flow profile, along with associated friction forces, causes the velocity profile of the flow stream to be non-uniform, namely, helically shaped.

In addition to vortex pair formation caused by the above-mentioned factors, the piping system itself will tend to create formations of separate vorticies or eddie currents. More specifically, the physically changing directions and angles of the pipework such as 90 degree bends or very sharp corners approaching that angle, will also cause an additional amount of pressure loss to be imparted to the flow stream. Under these specific conditions, flow will actually separate from the inner wall downstream of the 90 degree bend, intensifying pressure losses caused from vortex pair formations. The sum of these two types of pressure losses becomes even more pronounced when the flow velocity is increased.

It has been learned that in designing flow nozzles the pressure losses in the main flow stream from the above-mentioned friction factors have a direct relationship on the length and bore diameters of the nozzle. Typically, it has been found that the length to diameter ratio must be at least 1.5, and is preferably 2.0 or greater, in order to achieve acceptable flow distribution performance from the nozzle. Accordingly, it is imperative that with large cooling towers, these vortex pair formations be accounted for in the nozzle design, especially where water spray pressures are to be operated from 0.75 psig to 3 psig. However, accounting for pressure loss recovery by making the length to diameter ratio larger is a method which is undesirable since physical size and height limitations of a tower are a major cost concern.

To resolve the difficulties noted above, the present invention provides generally an improved fluid distributing nozzle which, when combined in a system comprising a plurality of such nozzles, provides even fluid distribution to an underlying surface over a wider range of operating pressures than prior nozzles without reduction in performance due to the frictional pressure losses within the nozzle.

The nozzle of the present invention is intended to operate at spray pressures in the range of 1–3 psig (6.89–20.67 Pa), though it has operated well at pressures as low as 0.75 psig (5.1675 Pa). The nozzle of the present invention is also considered large when compared to prior art nozzles, thereby minimizing the number of nozzles required in any given application. Accordingly, the nozzle of the present invention has been designed to maximize the operating characteristics of the nozzle through improvement of the flow profile entering the nozzle. By improving the entering flow profile, a more uniform velocity profile is maintained within the nozzle bore. This uniformity will help prevent formation of vorticies which can induce air into the nozzle and cause sputtering and vibration of the nozzle, ultimately reducing nozzle performance.

The nozzle of the present invention is related to the one disclosed in our pending application Ser. No. 738,681 filed Jul. 31, 1991 in which the main body has a substantially cylindrical bore therein. At about the mid-point of the main body, on its outer wall, is a pair of diametrically spaced supports for holding the nozzle in a header pipe. Four legs support a deflecting member in a vertically spaced relation under the cylindrical bore. The deflecting member is comprised of a top deflector which is in the shape of a four sided, acute angle pyramid and a bottom member which is in the shape of a frustum of a four sided obtuse angle pyramid. The top deflector is positioned on top of the bottom deflector such that the sides of the top and bottom deflector are generally aligned. This invention incorporates as an integral piece of the main body, anti-vortexing ears which are aligned in the same plane as the diametrically spaced supports.

SUMMARY OF THE INVENTION

One of the main objects of the present invention is to resolve the difficulties of friction losses noted above by providing a spray nozzle with anti-vortex means to counteract the vortex pair formations.

It is another object of the present invention to provide an improved spray nozzle that is characterized by a uniform flow pattern profile across the nozzle bore such that the nozzle will experience higher discharge coefficients, and hence higher exit flow rates over a wider range of operating pressures.

It is a final object of the invention to provide an improved spray nozzle which will allow header branch velocities to be substantially increased without the formation of vortices.

DESCRIPTION OF THE PREFERRED EMBODIMENT

Figure 1:
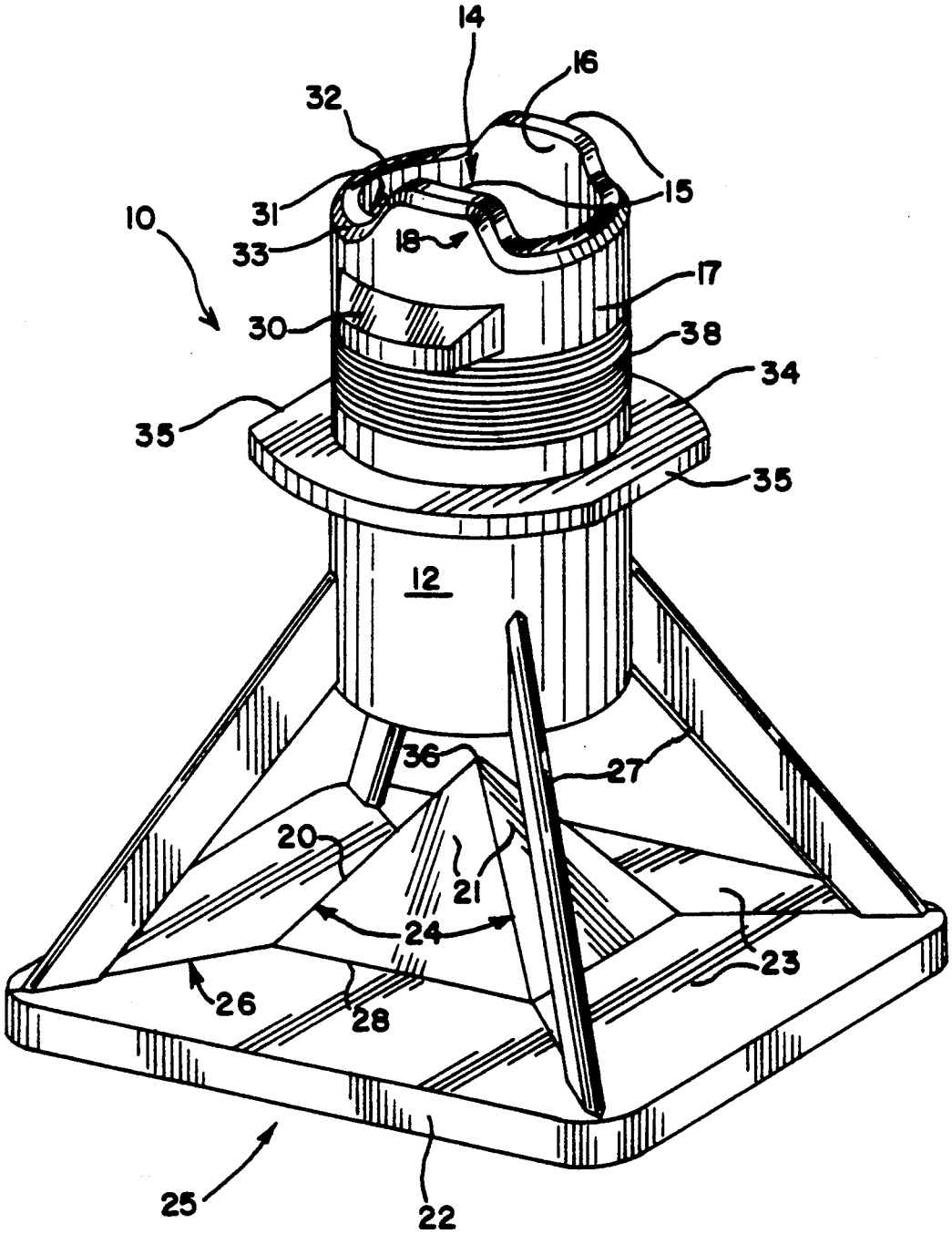
FIG. 1 is an isometric view of a nozzle in accordance with the present invention.

Referring to FIG. 1, there is shown generally at 10 an isometric view of a nozzle incorporating the present invention. Nozzle 10 comprises main body 12 which is of general cylindrical shape. Main body 12 includes axial bore 14 which also is generally cylindrical in shape and which passes through main body 12 to create a channel for fluid flow therethrough. Main body 12 of nozzle 10 has a top face 32, which is rounded to promote some of the fluid entrance into axial bore 14. Top edge 32 also includes a pair of diametrically spaced anti-vortex ears 15 integrated as part of the top of main body 12 of nozzle 10. Ears 15 extend upwards past top face 32 approximately 0.5 inches (1.2 cm) and are approximately 0.25–0.375 inches (0.635–0.9525 cm) in length, following the circumference of main body 12. The thickness of ears 15 is the same as main body 12, with outside edge 13 rounded, while inside edge 16 is squared to promote smoother flow into axial bore 14. As seen from FIG. 1, the outside and inside surfaces 16,18 of ears 15, are complementary in surface shape to the corresponding outside and inside surfaces 17,13 of main body 12 and are actually integrally formed as part of main body 12. Circumferential grooves 38 extend about the outside surface 17 of main body 12 over an extended vertical area of approximately 0.25–1.5 inches (0.635–3.81 cm). Grooves 38 are typically about 0.03 inches (0.0762 cm) deep and are used for securing main body 12 inside a holder means, as will be explained later.

Attached to the outside surface 17, generally at the bottom of main body 12, are supporting legs 27 which are of an elongated, rectangular shape. Supporting legs 27 are positioned on main body 12 at 90 degrees intervals and radiate outward and downward from each point of attachment on main body 12. Supporting legs 27 attach at their opposite end to deflector shown generally as 25.

Deflector 25 is comprised of top deflector 20 and bottom deflector 22. In its preferred embodiment top deflector 20 is in the shape of an acute angle pyramid which is comprised of 4 equal triangular shaped sides 21. Each triangular side 21 is sloped at an angle of about 45 degrees from vertical such that the top points of sides 21 form a vertex 36 at the top and center of pyramid 20. Sides 21 of top deflector 20 are joined to form edges 24. Edges 24 are generally slightly rounded to allow fluid flowing down top deflector 20 to "wrap-around" edges 24 rather than shearing off.

Although top deflector 20 is shown as an acute angle pyramid with sides being sloped approximated 45 degrees from vertical, it is anticipated that other alternative angles could be successfully utilized. Also, it is possible that top deflector 20 could have as few as 2 sides or have greater than four sides. In addition, it is possible that top deflector 20 could be in the shape of a regular cone or in the shape of a cone with inwardly curved, concave sides.

Top deflector 20 is positioned on top of, and at the center of bottom deflector 22. Bottom deflector 22 is typically in the shape of a frustum of an obtuse angle pyramid and is comprised of 4 equal sides 23. Sides 23 of bottom deflector are trapezoidal in shape and join at their sides to form edges 26. The top of trapezoidal sides 23 are of the same length as the base of triangular sides 21 and are joined together at 28 such that edges 24 of top deflector 20 and edges 26 of bottom deflector 26 are in general alignment. Similarly to top deflector 20, bottom deflector 22 could have as few as 2 sides or have greater than four sides. Deflector 25 is attached to main body 12 via supporting legs 27 which are attached to bottom deflector 22 at a top of each corner thereof.

Whereas deflector 25 has been shown comprising top deflector 20 and bottom deflector 22, an alternative embodiment would be to utilize a deflector 25 comprising only a single deflector. Typically in such case, the single deflector will be in the general form of an obtuse angle pyramid.

Nozzle 10 also comprises two supports 30, only one of which is shown on FIG. 1. Supports 30, which protrude from outside surface 17, near the top of main body 12, are positioned 180 degrees apart from each other, and are aligned directly under anti-vortexing ears 15. Supports 30 function to hold nozzle 10 in place within the spray pressure piping during operation. Supports 30 are typically of a curvilinear shape and are about 0.125–0.25 inches (0.3175–0.635 cm) in height, protrude approximately 0.125–0.375 inches (0.3175–0.9525 cm) away from surface 17 on main body 12, and have a length which is generally about 0.25–0.375 inches (0.635–0.9525 cm), following the circumference of main body 12.

Nozzle 10 also comprises shoulder 34 which is positioned at about mid-length of main body 12. Shoulder 34 is typically an annular ring with two diametrically opposite flat sides 35. Flat sides 35 are located radially about main body 12 such that they are 90 degrees transposed from supports 30. This is done to provide a means for properly aligning the support means 30 and the anti-vortexing ears 15 within the header pipe once nozzle 10 is inserted into the pipe. Shoulder 34 typically protrudes from surface 17 of main body 12 about 0.375–0.75 inches (0.9525–1.905 cm) and is about 0.125–0.25 inches (0.3175–0.635 cm) in thickness. Shoulder 34 continues about the entire circumference of main body 12.

Nozzle 10 is generally molded in a single piece out of polypropylene, though it is possible that other materials could be utilized. Also, nozzle 10 could be molded in multiple components which would than be assembled.

Figure 2:
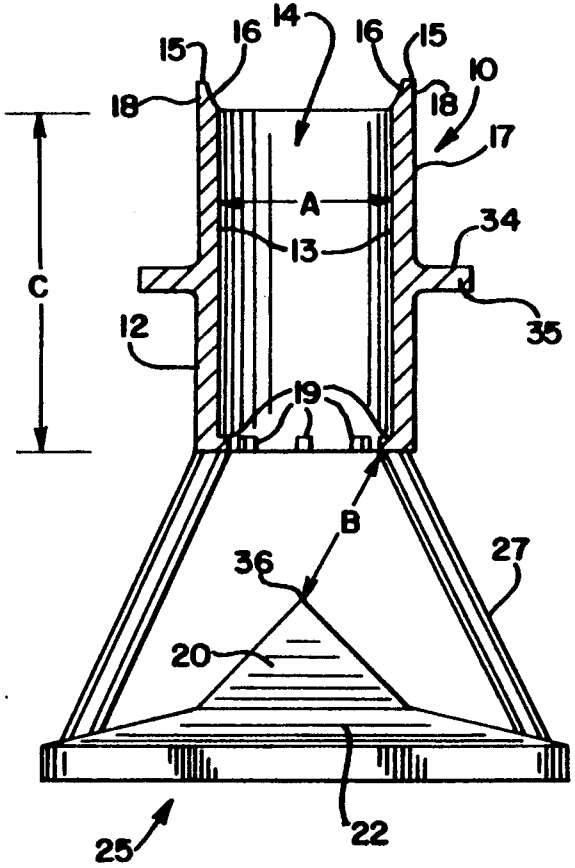
FIG. 2 is a partial side view of a nozzle in accordance with the present invention illustrating the position of the anti-vortexing ears within the header pipe.

Referring now to FIG. 2 there is shown generally at 10 a cross sectional side view of the nozzle of the present invention. Note that identical reference numerals are used on FIG. 2 and FIG. 3 to refer to the same components as where shown in FIG. 1. As described previously, nozzle 10 comprises main body 12 having axial bore 14 and comprises supporting legs 27 and deflector shown generally as 25. Main body 12 also comprises support knobs 19 which are typically about 0.125 inches (0.3175 cm) in height and width and with a thickness of about 0.060 inches (0.1524 cm). Support knobs 19 are spaced equidistantly about on the inside surface 13 of main body 12 at the bottom of axial bore 14.

The diameter of axial bore 14 is shown as "A" and is typically in the range of 0.25–3.0 inches (0.635–7.62 cm). This diameter is considerably larger than has been used previously in the art and provides a non-clogging passageway through which a large volume of fluid may pass.

Diameter A generally will be used to determine the length of main body 12 which is shown as "C". It has been learned that the ratio of length to diameter of axial bore 14, that is the ratio of C to A, is critical to achieving acceptable flow distribution from nozzle 10. Typically, the length to diameter ratio must be at least 1.5 and preferably is 2.0 or greater. Accordingly, axial bore diameters of 0.25–3.0 inches (0.635–7.62 cm) will necessitate using a axial bore length preferably of 0.5–6.0 inches (1.27–15.24 cm), though the axial bore length could be as short as 0.375 inches(0.9525 cm).

Diameter A will also be used to determine the distance that deflector 25 will be spaced underneath main body 12. In order to provide a non-clogging nozzle, it is necessary to provide a large, clear passaway for fluid flow throughout the entire nozzle. Thus, to eliminate the possibility that a particle may pass through axial bore 14 and become lodged at some other location of the nozzle, deflector 25 is positioned below 12 such that the distance B between vertex 36 and the bottom inside surface 13 of main body 12 will be at least equal to diameter A. As a result, any particle which passes through axial bore 14 will be able to pass through the entire nozzle without becoming lodged therein.

Figure 3:
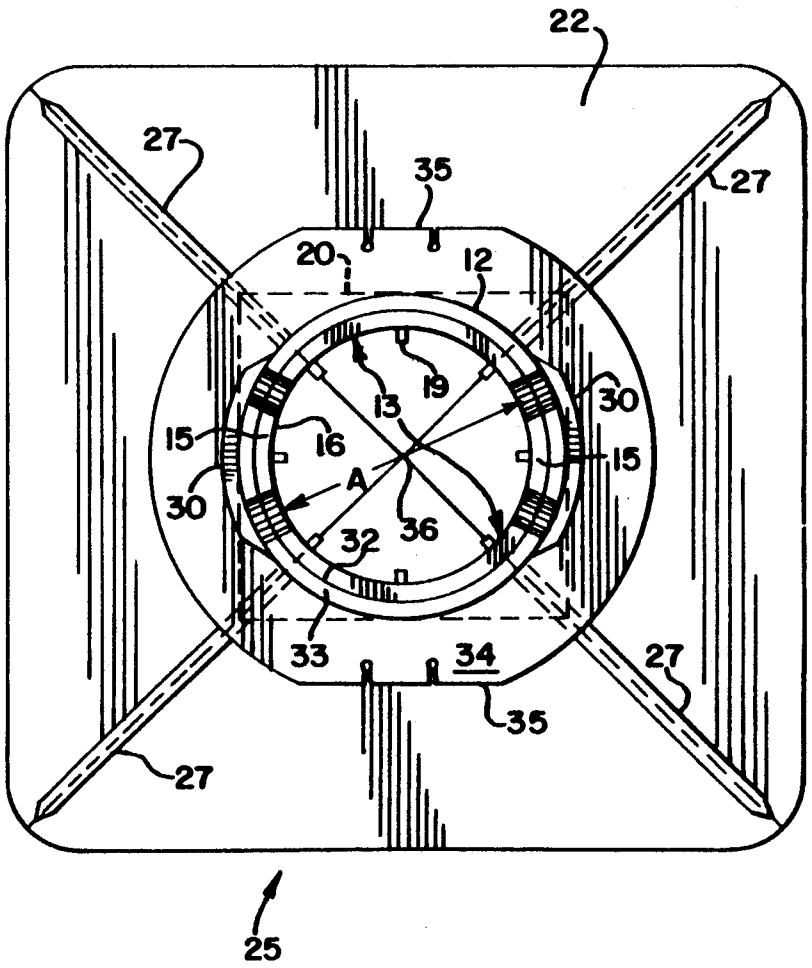
FIG. 3 is a plan view of the nozzle in accordance with the present invention.

Referring now to FIG. 3, there is shown a plan view of nozzle 10 of the present invention. Again, note that nozzle 10 is comprised of main body 12 having axial bore 14 therein, supporting legs 27 and deflector shown generally as 25. From this drawing, it is evident that flat sides 35 of shoulder 34 are generally positioned 90 degrees transposed from supports 30.

Also, an important feature of nozzle 10 is that the base of top deflector 20 is at least as wide as in diameter A of axial bore 14. The result from this feature is that all fluid flowing downward through axial bore 14 first impacts a surface which is at a substantial vertical angle. Accordingly, this allows for a smooth turning of the fluid from a substantially vertical direction to a direction having a significant horizontal vector component without creating excessive splash or splatter which otherwise occurs when a vertical stream impacts a substantially horizontal surface.

FIG. 3 also shows that vertex 36 is centrally located underneath axial bore 14. Accordingly, fluid flowing downwardly through axial bore 14 is divided into 4 substantially equal streams.

Referring again to FIG. 1, the operation of the nozzle in accordance with the present invention will be explained. It is anticipated that nozzle 10, which incorporates the anti-vortexing ears 15, can be utilized an any number of applications where it is desired to evenly distribute fluid to an underlying surface. For example, a typical application where nozzle 10 of the present invention will be utilized is in the distribution system of a water cooling tower.

Generally in a cooling tower application, the nozzle would be affixed to a water distributing header, though it could also be utilized in a gravity feed basin. In either case, water would generally approach nozzle 10 from either horizontal direction and then turn downward 90 degrees and flow into axial bore 14. However, before entering bore 14, the water that is flowing down the header pipe encounter friction forces from the water scraping against the walls of the pipe. As the flow stream fights to overcome the friction along the pipe walls, centrifugal-type forces are imparted to the flow stream. These forces actually split the flow stream in two, thereby creating a pair of spinning flow profiles, or vortex pairs within the flow stream itself. As the flow continues down the header and towards nozzle 10, the flow eventually encounters anti-vortexing ears 15 on the top of nozzle 10 before entering bore 14. Anti-vortexing ears 15 are designed to extend about 0.5 inches (1.27 cm) above the top surface 32 of nozzle 10 and positioned such that they are in line with the center of the flow stream profile. In this way, when the center of the flow profile encounters ears 15, the ears act as a wall which interrupts the spinning action of each vortex pair, which in turn, prevents re-formation of the vortex pairs downstream of ears 15. This means that when the vortex pairs are prevented from forming, the flow profile loses its typical helical shape and forms a flatter, uniformily shaped flow profile. Although ears 15 interrupt the vortex action, there is still enough room for the water to flow around ears 15 to provide nozzle 10 with sufficient amounts of water. After passing ears 15, the water stream now has the characteristics of uniform flow, which is an ideal and desirable flow condition for any nozzle to function at its peak performance.

As previously mentioned, abrupt flow directional changes such as the one encountered when the flow enters the nozzle, will create the formation of additional eddies or vorticies. This would mean that if anti-vortex ears 15 were not incorporated into nozzle 10, the vortex pairs formed by the friction in the piping system would cumulatively add together with any vortices created by abrupt directional flow changes, thereby magnifying pressure losses within the nozzle. Accordingly, if inlet 32 of main body 12 had no anti-vortexing ears 15 and was instead "squared-off" at its top, the abrupt directional change into the nozzle would creat a another venturi contracti point just inside bore 14, such that an area of low pressure within the nozzle would be formed. This low pressure area would also cause air from within the pipe to be sucked into the fluid flow stream within axial bore 14. Once within axial bore 14, the air would become pressurized, and upon exiting axial bore 14 into the lower-pressured outside atmosphere, it would expand and cause excessive splatter upon impacting top deflector 20. If this were to occur, the planes of fluid formed by the nozzle would not be as uniform, stable or flat as preferably desired. For this reason, top face 32 of nozzle 10 has the outside edge 33 rounded, while inside edge 31 is left squared. In this way, smoother entry way into the nozzle will help reduce some of the effect of the eddies formed upon abrupt changes in flow direction. Even with a rounded leading edge on the nozzle, lack of anti-vortexing ears 15 would still have allowed vortex pairs to reach the exit end of nozzle 10, with the spinning action actually inducing outside air into the vortex pairs. The induced air would result in sputtering and vibration of the nozzle because the induced air would temporarily resist the water from exiting. The sputtering and non-uniform flow leaving nozzle 10 combines with other trapped air to lower the amount of flow leaving the nozzle, thereby lowering the nozzle discharge coefficient and accordingly, making distribution over surface 70 non-uniform. Ears 15 therefore, ensure a smooth, stabilized flow profile into axial bore 14, preventing turbulence and the induction of air into the flow stream.

Figure 7:
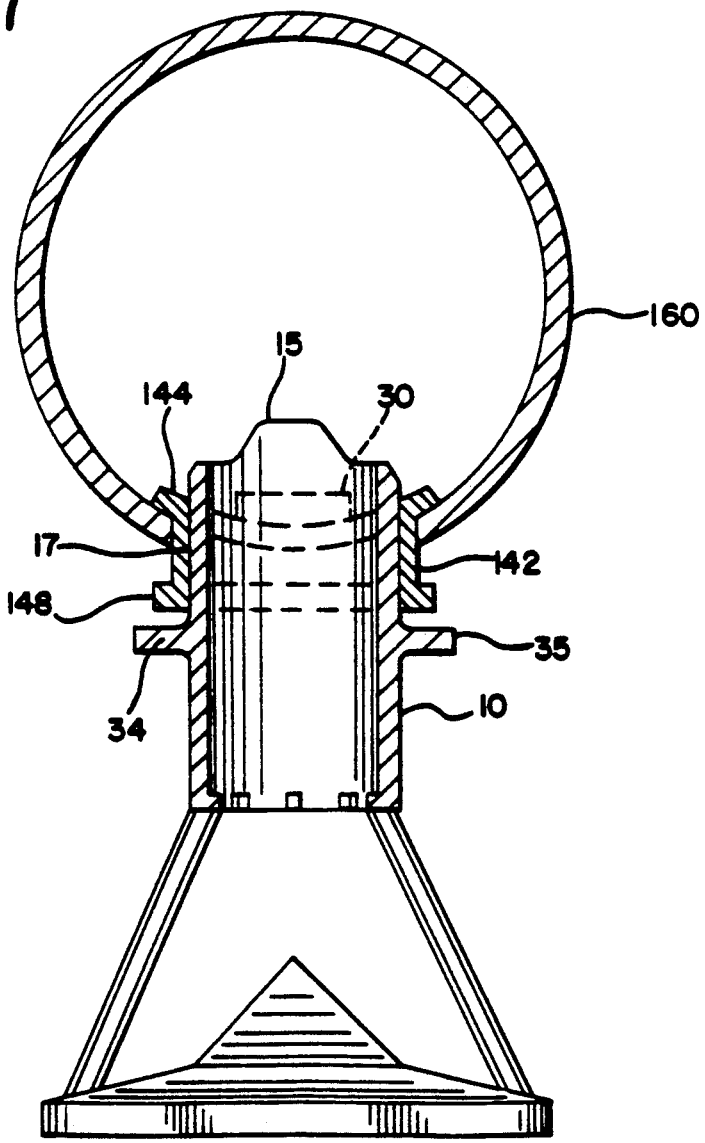
FIG. 7 is a side view showing the nozzle anchored inside the header pipe, emphasizing the correct orientation of the anti-vortexing ears.

It should be understood that for proper nozzle operation which incorporates the present invention, the orientation of anti-vortexing ears 15 must be correctly aligned within the header pipe in order for ears 15 to properly work and eliminate the vortex pairs. As seen in FIG. 7, the supports 30 and ears 15 are incorporated into the design of main body 12 such that they are aligned in the same direction, both members being exactly 180 degrees apart. This alignment is purposely provided so that once nozzle 10 is inserted into header pipe 160, the orientation of ears 15 is known indirectly through the orientation of shoulder 34. Since ears 15 and supports 30 cannot be seen once the nozzle is inserted into the pipe, shoulder 34, on the outside of the pipe, can be viewed and used as a guage to indicate the orientation of ears 15. The flat side 35 of shoulder 34 is 90 degrees transverse to the proper alignment of ears 15 when they are inside the pipe, thus, flat side 35 will always be aligned with to the longitudinal axis of pipe 160. As mentioned, since each vortex pair formation has a common tangential point at the center of the pipe when spinning, ears 15 must be aligned within the flow stream in order to completely eliminate the vortex pairs. Only if ears 15 are rotated 90 degrees, will they not be effective in eliminating the vortex pair formation.

Also, in this particular embodiment of the present invention, nozzle 10 is shown with with two anti-vortexing ears 15 because this particular nozzle design is 180 degrees symmetrical, meaning that it can be installed within a header pipe in either of two ways. Therefore, two ears 15 are necessary to cover both possible insertion arrangements within the header pipe. On the otherhand, it to be understood that it is the actual design and type of nozzle being used which dictates whether a single or dual anti-vortexing ear 15 will be employed. From a purely operational standpoint, only a single anti-vortexing ear 15 is truly needed on the upstream side of the flow entering nozzle 10 in order to function as intended, therefore, it is possible that a nozzle, like the one in FIG. 1, will only have one anti-vortexing ear 15.

Upon exiting axial bore 14, the free jet of fluid enters the atmosphere and continues to flow vertically downward whereupon it impacts vertex 36 of top deflector 20. Also, as fluid streams are flowing down sides 21, the fluid spreads out to cover the entire surface area of side 21. As previously stated, it is possible that different forms of pyramids or conical deflectors could be used such that the fluid would be divided in either less than or greater than four streams, depending upon the particular application.

When the fluid streams reach the bottom of top deflector 20, the direction of fluid stream flow is again changed due to the impact of the stream flow with sides 23 of bottom deflector 22. In impacting sides 23, the fluid streams are typically turned about an additional 30 degrees towards horizontal such that the streams are flowing at an angle of about 15 degrees from horizontal. In flowing over sides 23, the fluid streams spread out to cover substantially the entire surface of sides 23 causing the streams to flatten into planes of fluid. Upon leaving sides 23 of bottom deflector, the streams of fluid are relatively flat, stable planes of fluid flowing at a direction of about 15 degrees from horizontal. When utilizing a four sided pyramid of the preferred embodiment, the planes of fluid generally fan out in a horizontal direction from an angle of 90 degrees such that flow is created around the nozzle in 360 degrees direction. Note that if an alternative deflector were used, it would be possible to vary the flow direction and coverage such that streams of either less than or greater than a 90 degrees fan shape may be created. Such streams may or may not cover the entire 360 degrees area about the nozzle. For example, two 120 degrees fan shape planes may be created, among others. In all cases, the fluid planes have substantially uniform fluid flow across their width.

Figure 4:
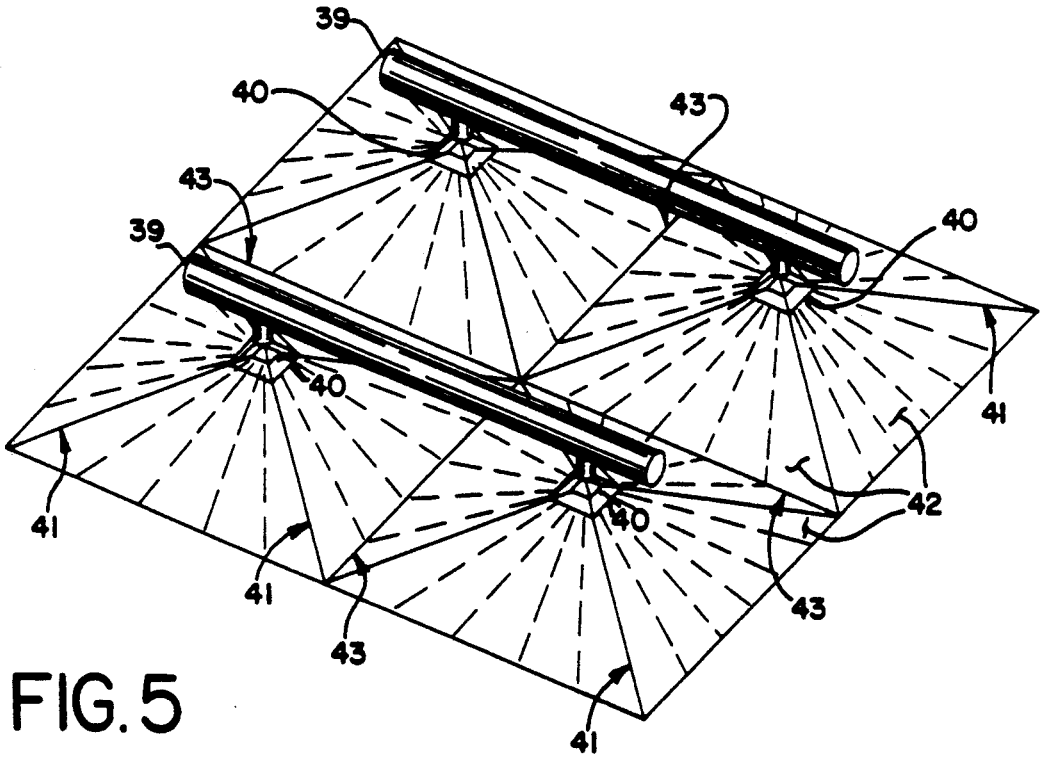
FIG. 4 is an isometric view of a header and nozzle arrangement in accordance with the present invention to illustrate the uniform spray patterns generated by the nozzle.

As shown on FIG. 4, the nozzles of the present invention are typically utilized in a spray distribution system containing multiple nozzles. Shown on this figure are four nozzles 40 of the present invention affixed to two fluid headers 39. Typically, nozzles 40 are spaced approximately 12–48 inches (0.3048–1.2192 m) apart on a header 39 with the fluid headers being generally parallel to each other and spaced approximately 12–48 inches (0.3048–1.2192 m) apart from their centerlines. This spacing is much large than typically used in pressure spray distribution systems. Fluid headers 39 are generally placed approximately 8–36 inches (0.2032–0.9144 m) above the surface to which fluid is being distributed, which is similar to the spacing typically used in pressure spray distribution systems.

As can be seen from FIG. 4, nozzles 40 each produce four uniform flat planes of fluid 42 spreading out in a 90 degrees fan shape away from nozzles 40 and sloped at an angel of about 15 degrees from horizontal. Each of flat planes 42 are bounded by edges 41. The resulting fluid planes form a pattern 360 degrees about each nozzle.

One reason for the uniform distribution achieved with the nozzle and distribution system of the present invention results from the fact that fluid planes 42 produced from a given nozzle intersect fluid planes produced by adjacent nozzles in all directions. These intersections are shown as 43 on FIG. 4. The action of intersecting with other planes produces a dispersion of fluid underneath the plane. Although the action of impacting the sprays from one nozzle with the sprays from another nozzle is not new, the nozzles of the present invention improve upon the distribution obtained by such action through the creation and intersection of refined, uniform, stable flat planes of fluid.

In prior art intersecting spray systems, the planes of fluid which were intersected were not stable, flat, or uniform. Accordingly the fluid distribution resulting from the intersections was poor. This is particularly true where such prior art systems were operated at spray pressures less than 3 psig.

Figure 5:
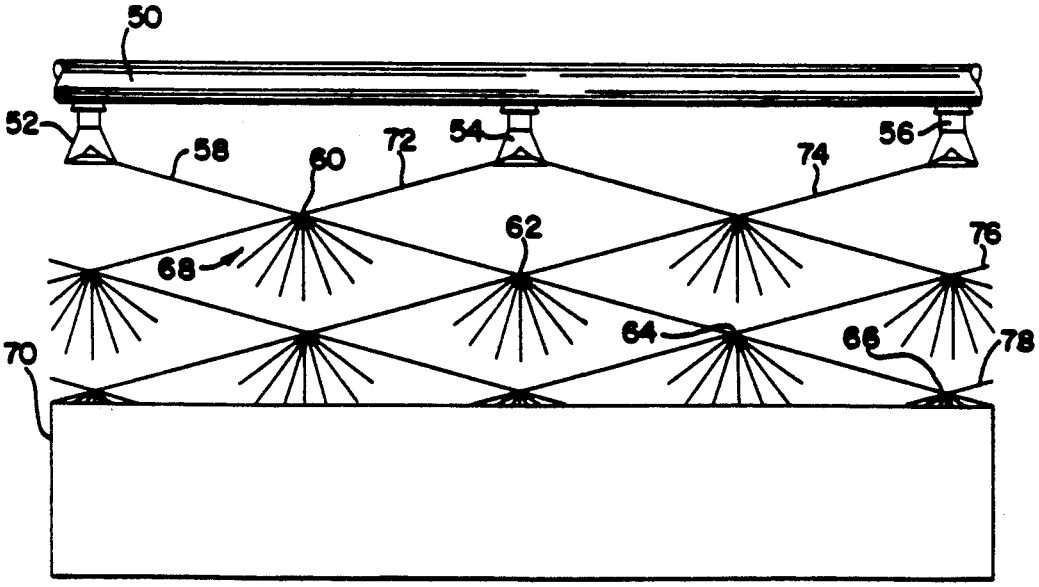
FIG. 5 is side view of a header and nozzle arrangement in accordance with the present invention illustrating the spray pattern generated and the locations of the primary and secondary intersections produces.

In FIG. 5, nozzles 52, 54, and 56 are affixed to spray header 50. Each of nozzles 52, 54 and 56 are in operation and are producing four uniform planes of fluid, though only two planes per nozzle are shown. The distribution system is operational to provide fluid uniformly to underlying surface 70, which in an evaporative cooling device would be a heat transfer surface typically comprised of either a plurality of fill sheets, fluid conduits, or other heat transfer surface.

As stated previously, the nozzle of the present invention is large and had a much greater volumetric capacity when compared to prior art nozzles. Accordingly, the force placed upon the nozzle by the fluid passing through and being deflected by the nozzle is also much greater than that encountered by previous prior art nozzles, especially when the nozzle of the present invention is used in a pressure spray distribution system. Further, there may be instances where the spray pressure to which a nozzle is exposed is significantly greater than normal operating pressure due to upset or abnormal operating conditions. As a result, the nozzle of the present invention is shown fastened to the header pipe by grommet 140 and is retained by supports 30, which prevent the nozzle from being dislodged from the pipe during operation. This feature is important because, in a cooling tower application, nozzles which become displaced during operation can cause damage to the underlying heat transfer surface necessitating extensive and costly repairs.

Figure 6:
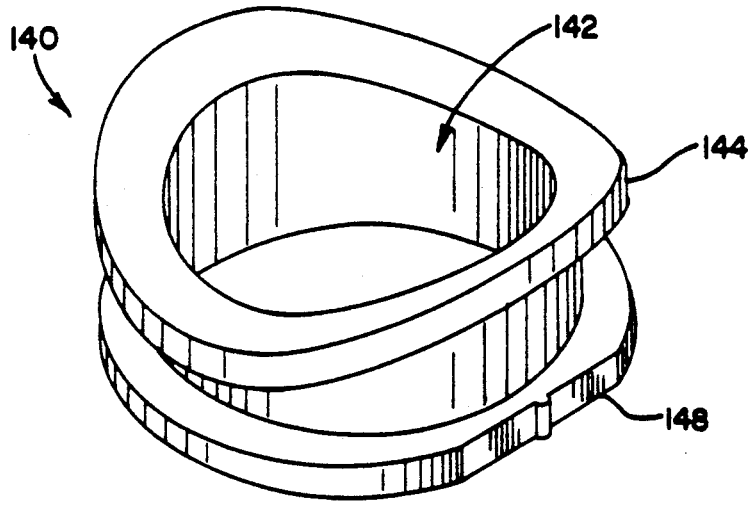
FIG. 6 is an isometric view of the saddle grommet which is used to anchor the nozzle of the present invention into the header pipe.

Referring now to FIG. 6, there is shown generally at 140 a grommet which is to be used to fasten the improved nozzle of the present invention to the header pipe. Grommet 140 is generally of a thin-walled cylindrical shape with axial bore 142. The inside diameter of axial bore 142 is typically approximately equal to the outside diameter of the nozzle of the present invention. Grommet 140 also comprises a saddle shaped top edge 144 which is designed to fit the inside curvature of a 6 inch pipe. Bottom edge 146 is generally flat. Both top edge 144 and bottom edge 146 extend around the circumference and radially outward to grommet 140. Grommet 140 is typically molded in one piece utilizing either an isoprene or neoprene rubber material having a durometer in the range of 40 to 70, though other similarly flexible materials could be used.

FIG. 7 is side cross-sectional view of a nozzle of the present invention and the spray header utilizing the grommet to fasten nozzle 10 to the header pipe 160. Typically, grommet 140 is inserted into a hole formed into header pipe 160. Note that both top edge 144 and bottom edge 146 of grommet 140 are shown in their entirety in dashed line form. Top edge 144 of grommet 140 fits inside pipe 160 such that top edge 144 rests upon the follows the contour of the inside of pipe 160. Bottom edge 146 remains outside of pipe 160.

Nozzle 10 is inserted into grommet 140 with the flat side 35 of shoulder 34 in a position perpendicular to the longitudinal axis of pipe 160. Once nozzle 10 has been inserted far enough into grommet 140, nozzle 10 is turned about 90 degrees to align supports 30 and anti-vortexing ears 15 with the longitudinal axis of pipe 160. Nozzle 10 is then pulled downward until supports 30 rest upon top edge 144 of grommet 140. Grooves 38 of nozzle 10 impress into the side wall 142 of flexible grommet 140 to provide additional support and sealing. As described earlier, the particular nozzle being employed might only utilize a single anti-vortexing ear 15. In that situation, the anchoring and positioning of the single ear nozzle within pipe 160 would be exactly the same as the dual ear nozzle shown in FIG. 7, except that the single ear would be facing the upstream side of the flow stream, which would be flowing down pipe 160 towards nozzle 10.

What is claimed is:

1. A method of connecting a fluid distribution nozzle having anti-vortexing ears and supports adjacent a top portion of said nozzle into a large diameter spray pressure pipe which has a longitudinal centerline comprising the steps of:

providing a hole in said spray pressure pipe along said longitudinal centerline of said spray pressure pipe;

inserting a connecting means into said hole; and inserting said nozzle into said connecting means such that said supports interact with said connector means to hold said nozzle in place within said spray pressure pipe, said supports resting on top of said connecting means and said anti-vortexing ears extending partially into said spray pressure pipe.

2. The device of claim 1 wherein said anti-vortexing ears and said supporting means are in alignment with said longitudinal centerline of said spray pressure pipe.

3. The method of claim 2 wherein said fluid distribution nozzle has a single anti-vortexing ear, said ear aligned with the longitudinal centerline of said pipe and facing fluid provided within said pipe.

4. An improved fluid distribution device for insertion into a spray pressure pipe having a longitudinal axis comprising:

a cylindrical body having a longitudinal axis, a wall with a wall thickness, said wall defining a generally longitudinal axial throughbore, an inside surface, an outside surface, a top endface, a bottom endface, each of said endfaces intersecting with said inside and outside surfaces, each of said top and bottom endfaces having an inner edge and an outer edge at said intersecting inside and outside surfaces, respectively;

a pair of diametrically spaced anti-vortexing ears attached to said top endface of said cylindrical body, each of said ears extending vertically upward above said top endface of said body;

a pair of diametrically spaced supports attached to said outside surface of said cylindrical body, each of said supports disposed between said anti-vortexing ears and an alignment shoulder, said supports projecting perpendicularly from said body for support thereof when inserted within said pipe; and an alignment indicating shoulder encompassing said cylindrical body about the longitudinal midsection of said body, said shoulder including a pair of opposed straight sides connected together by a pair of transversely opposed arcuate sides, said straight sides aligned with said supports such that said anti-vortexing ears are correctly aligned with said longitudinal axis of said pipe when said ears and said supports are inserted therein.

5. The device of claim 6 wherein said anti-vortexing ears have a thickness and shape corresponding to said body.

6. The device of claim 5 wherein each of said anti-vortexing ears and said cylindrical body form a single integral wall.

7. The device of claim 6 wherein said outer edge is rounded.

8. The device of claim 7 wherein said inner edge forms an acute angle.

9. The device of claim 8 further including a deflecting member disposed below and centered under said body throughbore, said member having means for attaching said body to said deflecting member.

10. The device of claim 9 wherein said anti-vortexing ears prevent vortex formations independent of flow direction into said axial throughbore.

11. The device of claim 10 wherein said cylindrical body has a single anti-vortexing ear.

12. A fluid distribution system comprising:

a series of spray water distribution pipe containing flowing water within the interior of said pipes, each of said pipes having a longitudinal axis;

a surface over which the water is to be distributed;

and means for discharging the water from within said spray water distribution pipes over said surface, said means including a plurality of fluid distribution nozzles insertably attached to the bottom of said water distribution pipes and arranged in a spaced horizontal relationship from each other above said surface, each of said nozzles including a cylindrical body with a vertical axis, said body including a generally vertical axial throughbore defining a top and a bottom end face, said top end face having at least one anti-vortexing ear in alignment with said longitudinal axis of said pipe when inserted therein, said anti-vortexing ear extending vertically upward from said top end face into said pipe interior for initially contacting said flowing water before said water enters said nozzle throughbore, said ear preventing vortex pair formations within said throughbore, thereby preventing air suction into said nozzle and resultant vibration thereof, wherein a uniform flow profile is formed within said nozzle throughbore such that a continuously uniform fluid plane of water is discharged from said nozzle.

13. The fluid distribution system of claim 12 wherein said nozzle has a pair of diametrically spaced anti-vortexing ears.

* * * * *